US010155389B2

(12) United States Patent
Araki et al.

(10) Patent No.: US 10,155,389 B2
(45) Date of Patent: Dec. 18, 2018

(54) HEAD CLEANING MECHANISM AND INK JET RECORDING APPARATUS INCLUDING THE SAME

(71) Applicant: KYOCERA Document Solutions Inc., Osaka (JP)

(72) Inventors: Takuma Araki, Osaka (JP); Kenichi Satake, Osaka (JP); Yasutaka Inui, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/856,885

(22) Filed: Dec. 28, 2017

(65) Prior Publication Data

US 2018/0194140 A1 Jul. 12, 2018

(30) Foreign Application Priority Data

Jan. 11, 2017 (JP) ..... 2017-002333
Jan. 18, 2017 (JP) ..... 2017-006872

(51) Int. Cl.
*B41J 2/165* (2006.01)
*B41J 2/17* (2006.01)
*B41J 2/185* (2006.01)

(52) U.S. Cl.
CPC ..... *B41J 2/16538* (2013.01); *B41J 2/16552* (2013.01); *B41J 2/1707* (2013.01); *B41J 2/1714* (2013.01); *B41J 2/185* (2013.01); *B41J 2002/16502* (2013.01); *B41J 2002/16558* (2013.01)

(58) Field of Classification Search
CPC .. B41J 2/16538; B41J 2/16552; B41J 2/1707; B41J 2/1714
See application file for complete search history.

(56) References Cited

U.S. PATENT DOCUMENTS

2005/0231548 A1* 10/2005 Tsukada ..... B41J 2/16535 347/33
2013/0021409 A1* 1/2013 Jefferson ..... B41J 2/16535 347/33

FOREIGN PATENT DOCUMENTS

JP 2007-83496 A 4/2007

* cited by examiner

*Primary Examiner* — Jason S Uhlenhake
(74) *Attorney, Agent, or Firm* — Stein IP, LLC

(57) ABSTRACT

A head cleaning mechanism of the disclosure includes a recording head and a wiper. The recording head includes an ink ejection surface in which an ink ejection area with a plurality of ink ejection ports opened therein is provided. The wiper wipes the ink ejection surface in a specified direction. The recording head includes an inclined surface placed on an upstream side of the ink ejection surface in a wiping direction that is a direction in which the wiper wipes the ink ejection surface, the inclined surface being inclined downward toward a downstream side of the wiping direction. A plurality of cleaning liquid supply ports for supplying cleaning liquid are provided on a wiping-direction upstream side of a position in the inclined surface with which the wiper makes contact during wiping operation.

18 Claims, 14 Drawing Sheets

HEAD CLEANING MECHANISM AND INK JET RECORDING APPARATUS INCLUDING THE SAME

INCORPORATION BY REFERENCE

This application is based upon and claims the benefit of priority from the corresponding Japanese Patent Applications No. 2017-002333 filed on Jan. 11, 2017 and No. 2017-006872 filed on Jan. 18, 2017, the entire contents of which are incorporated herein by reference.

BACKGROUND

The present disclosure relates to a head cleaning mechanism including a recording head having ink ejection ports for ejecting ink onto a recording medium such as paper sheets, and also relates to an ink jet recording apparatus including the head cleaning mechanism.

As a recording apparatus like facsimiles, copiers and printers, ink jet recording apparatuses for ejecting ink to form images have been widely used by virtue of their capabilities of forming high-definition images.

In such an ink jet recording apparatus, minute ink drops (hereinafter, referred to as mist) ejected along with ink drops serving for image recording, or rebounded mist generated when ink drops stick to the recording medium, are deposited and solidified on an ink ejection surface of a recording head. When the mist on the ink ejection surface increases gradually so as to overlap with the ink ejection ports, there occur deterioration of ink flying linearity (flying curve), non-ejection and the like, causing the recording head to decline in print performance.

Under such circumstances, there has been known an ink jet recording apparatus in which with a view to cleaning the ink ejection surface of the recording head, a plurality of cleaning liquid supply ports are provided in outside portion (upstream-side portion in a wiping direction of a wiper) of an ink ejection area, where a plurality of ink ejection ports are opened, out of the ink ejection surface. In this ink jet recording apparatus, after cleaning liquid is supplied through the cleaning liquid supply ports, the wiper is moved along the ink ejection surface from outward of the cleaning liquid supply ports, by which the ink ejection surface can be wiped while the cleaning liquid is held by the wiper. In this way, recovery process for the recording head can be carried out.

SUMMARY

A head cleaning mechanism in one aspect of the present disclosure includes a recording head and a wiper. The recording head includes an ink ejection surface in which an ink ejection area is provided, the ink ejection area having a plurality of ink ejection ports opened therein for ejecting ink onto a recording medium. The wiper wipes the ink ejection surface in a specified direction. The recording head includes an inclined surface placed on an upstream side of the ink ejection surface in a wiping direction that is a direction in which the wiper wipes the ink ejection surface, the inclined surface being inclined downward toward a downstream side of the wiping direction. A plurality of cleaning liquid supply ports for supplying cleaning liquid are provided on a wiping-direction upstream side of a position in the inclined surface with which the wiper makes contact during wiping operation.

Still further objects of the disclosure as well as concrete advantages obtained by the disclosure will become more apparent from embodiments thereof described hereinbelow.

DETAILED DESCRIPTION

Hereinbelow, embodiments of the present disclosure will be described with reference to the accompanying drawings.

First Embodiment

Figure 1:
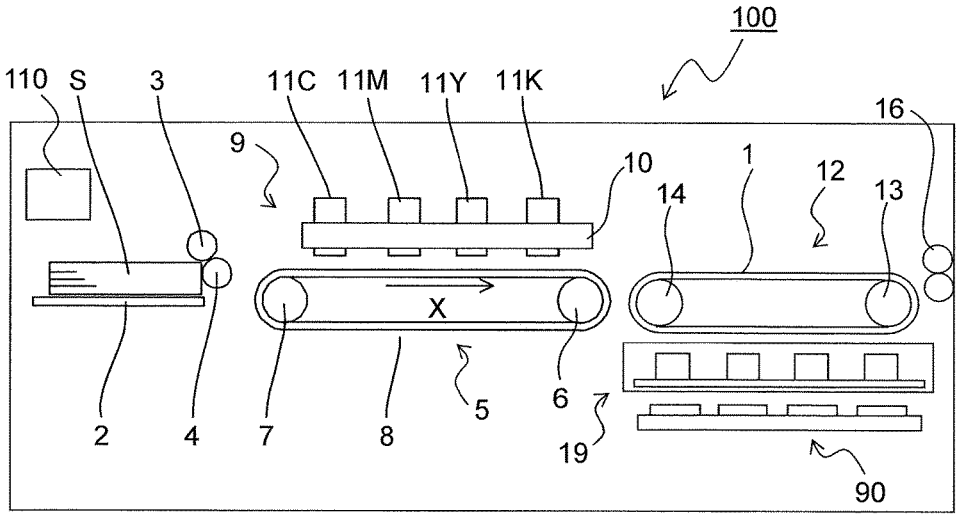
FIG. 1 is a view showing a structure of an ink jet recording apparatus including a recording head according to a first embodiment of the disclosure.

As shown in FIG. 1, a sheet feed tray 2 for housing paper sheets S (recording medium) is provided on the left side of an ink jet recording apparatus 100 according to a first embodiment of the disclosure. At one end portion of the sheet feed tray 2 are provided a sheet feed roller 3 for conveying and feeding the housed sheets S to a later-described first conveyance unit 5, sheet by sheet in order starting with the uppermost sheet S, as well as a driven roller 4 which is set in pressure contact with the sheet feed roller 3 so as to be driven into rotation.

A first conveyance unit 5 and a recording part 9 are placed on a downstream side (right side in FIG. 1) of the sheet feed roller 3 and the driven roller 4 relative to a sheet conveyance direction (arrow X direction). The first conveyance unit 5 has a configuration including a first driving roller 6, a first driven roller 7, and a first conveyor belt 8 stretched between and over the first driving roller 6 and the first driven roller 7.

By a control signal from a controller 110 of the ink jet recording apparatus 100, the first driving roller 6 is driven to rotate clockwise, by which the sheet S held on the first conveyor belt 8 is conveyed in the arrow X direction.

Figure 2:
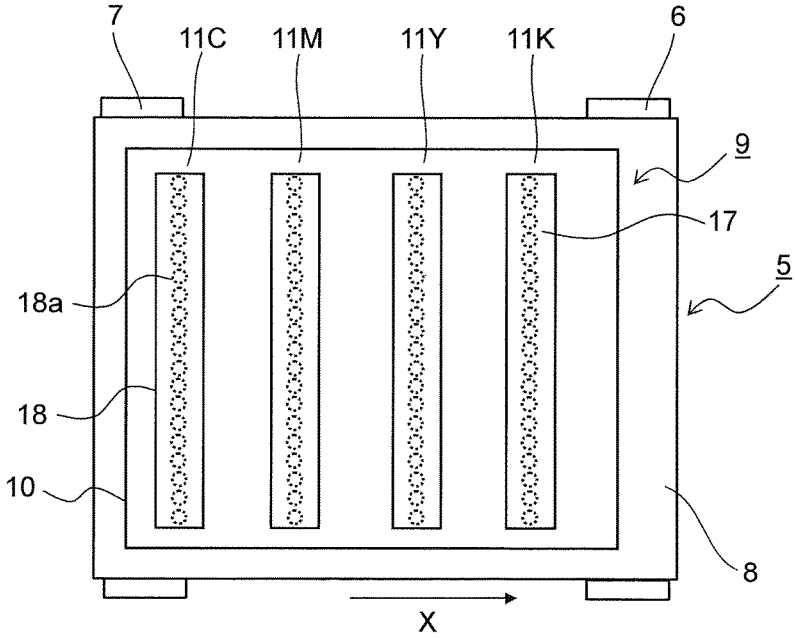
FIG. 2 is a view of a first conveyance unit and a recording part of the ink jet recording apparatus shown in FIG. 1, as viewed from above.

The recording part 9 includes a head housing 10, and line heads 110, 11M, 11Y and 11K held on the head housing 10. These line heads 110 to 11K are each implemented by one or more (one in this case) recording head 17 which is held at such a height as to form a specified gap (e.g., 1 mm) to a conveyor surface of the first conveyor belt 8 and which extends along a sheet widthwise direction (up/down direction in FIG. 2) perpendicular to the sheet conveyance direction as shown in FIG. 2.

Figure 3:
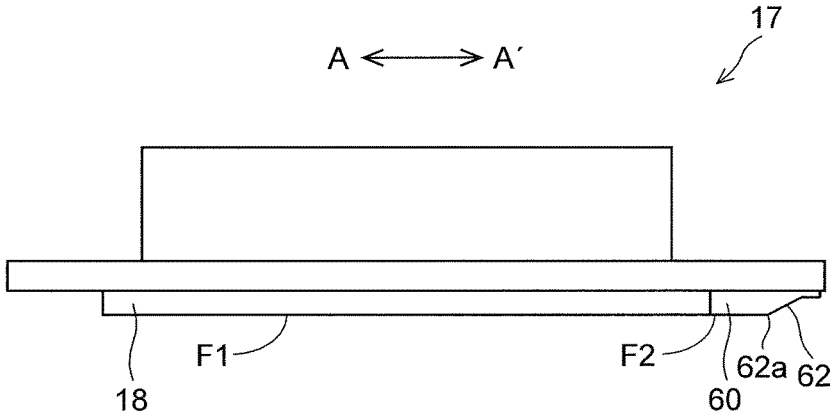
FIG. 3 is a view of the recording head including line heads of the recording part.
Figure 4:
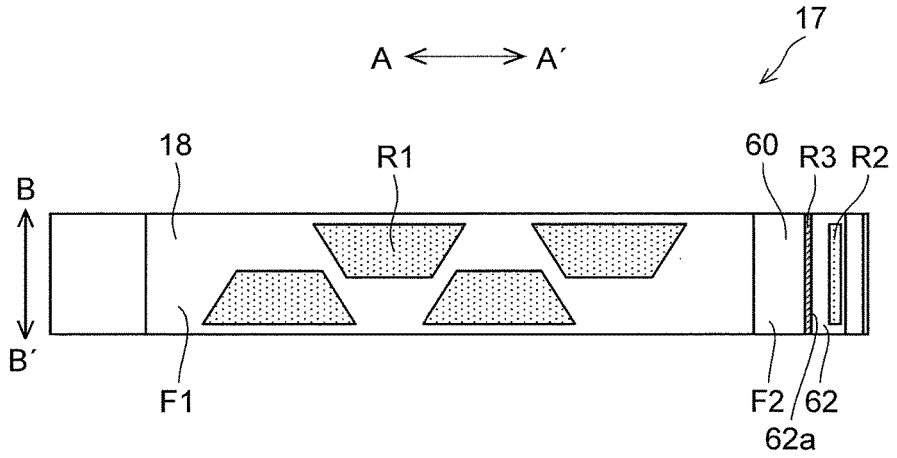
FIG. 4 is a view of the recording head, as viewed from the ink ejection surface side.

As shown in FIGS. 3 and 4, an ink ejection area R1 in which a multiplicity of ink ejection ports 18*a* (see FIG. 2) are arrayed is provided in an ink ejection surface F1 of a head portion (ink ejection head portion) 18 of the recording head 17. In addition, at least the ink ejection surface F1 of the head portion 18 is formed from SUS (stainless steel) as an example. The ink ejection surface F1 is processed for water repellency treatment by being coated with a fluoric- or silicon-base water repellent, where the ink ejection surface F1 has a contact angle of 113° to water.

The recording heads 17 forming the individual line heads 11C to 11K are supplied with ink in four colors (cyan, magenta, yellow and black) stored in their respective ink tanks (not shown) for individual colors of the line heads 11C to 11K, respectively.

Responsive to image data received from an external computer by a control signal from the controller 110 (see FIG. 1), each recording head 17 ejects ink from the ink ejection ports 18*a* toward the sheet S conveyed as it is sucked and held to the conveyor surface of the first conveyor belt 8. As a result, a color image in which inks for four colors of cyan, magenta, yellow and black are superimposed together is formed on the sheet S on the first conveyor belt 8.

The recording head 17 is also provided with a cleaning liquid supply member (cleaning liquid supply head portion) 60 for supplying cleaning liquid. The cleaning liquid supply member 60 is placed adjacent to the head portion 18 on an upstream side (right side in FIG. 3) in a wiping direction of a later-described wiper 35. Also, the cleaning liquid supply member 60 includes an inclined surface 62 inclined downward toward the downstream side of the wiping direction, and a lower surface F2 extending from a wiping-direction downstream end 62*a* (lower end in FIG. 3) of the inclined surface 62 toward the ink ejection surface F1.

The inclined surface 62 includes a cleaning liquid supply area R2 in which a multiplicity of cleaning liquid supply ports 60*a* (see FIG. 5) for supplying cleaning liquid are arrayed. The cleaning liquid supply member 60 is formed from, e.g., resin or SUS. Surfaces (e.g., inclined surface 62 and lower surface F2) of the cleaning liquid supply member 60 are processed for water repellency treatment weaker than that for the ink ejection surface F1, by being coated with a fluoric- or silicon-base water repellent, where the cleaning liquid supply member 60 has a contact angle of 95° to water. Detailed structure of the cleaning liquid supply member 60 will be described later.

Reverting to FIG. 1, a second conveyance unit 12 is placed on the downstream side (right side in FIG. 1) of the first conveyance unit 5 relative to the sheet conveyance direction. The second conveyance unit 12 has a configuration including a second driving roller 13, a second driven roller 14, and a second conveyor belt 15 stretched between and over the second driving roller 13 and the second driven roller 14. As the second driving roller 13 is driven into clockwise rotation, the sheet S held on the second conveyor belt 15 is conveyed in the arrow X direction.

The sheet S on which an ink image has been recorded in the recording part 9 is fed to the second conveyance unit 12. During passage through the second conveyance unit 12, the ink ejected on the surface of the sheet S is dried. Also, a maintenance unit 19 and a cap unit 90 are placed under the second conveyance unit 12. For execution of wiping operation by the later-described wiper 35, the first conveyance unit 5 is moved down, and the maintenance unit 19 is moved to under the recording part 9. Then, the wiper wipes off the ink forcedly discharged from the ink ejection ports 18*a* of the recording head 17 as well as the cleaning liquid supplied from the cleaning liquid supply ports 60*a*, and then collects the wiped ink and cleaning liquid. For capping of the ink ejection surface F1 (see FIG. 3) of the recording head 17, the first conveyance unit 5 is moved down, and the cap unit 90 is moved horizontally to under the recording part 9 and further moved upward so as to be fitted to the lower surface of the recording head 17.

Further, a discharge roller pair 16 for discharging the image-recorded sheet S to outside the apparatus body is provided on the downstream side of the second conveyance unit 12 relative to the sheet conveyance direction. A discharge tray (not shown) on which the sheet S discharged outside the apparatus body is to be stacked is provided on the downstream side of the discharge roller pair 16.

The maintenance unit 19 is composed of a plurality of wipers 35 (see FIG. 14) movable along the ink ejection surface F1, a generally rectangular-shaped carriage (not shown) to which the plurality of wipers 35 are fixed, and a support frame (not shown) for supporting the carriage. The carriage (not shown) is supported to the support frame (not shown) so as to be slidable in contact therewith in arrow AA' direction.

Figure 5:
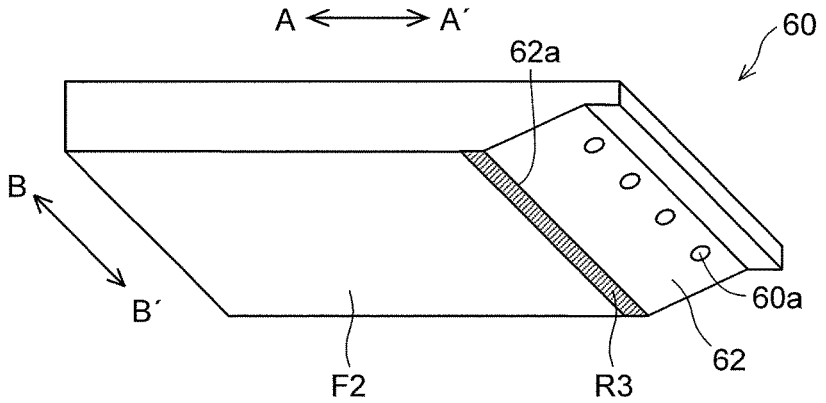
FIG. 5 is a view of a cleaning liquid supply member of the recording head, as viewed from obliquely below.

Each wiper 35 is an elastic member (e.g., rubber member formed from EPDM) for wiping off the cleaning liquid supplied through the cleaning liquid supply ports 60*a* of the recording head 17 (see FIG. 5). The wiper 35 is brought into pressure contact with wiping-direction downstream-side portion of the cleaning liquid supply area R2 (see FIG. 4) out of the inclined surface 62 of the cleaning liquid supply member 60, in which state the wiper 35 wipes the lower surface F2 and the ink ejection surface F1 in a specified direction (arrow A direction) through movements of the carriage (not shown). In addition, the maintenance unit 19, which includes the wipers 35, and the recording head 17 constitute a head cleaning mechanism.

Next, structure of the cleaning liquid supply member 60 will be described in detail.

Figure 6:
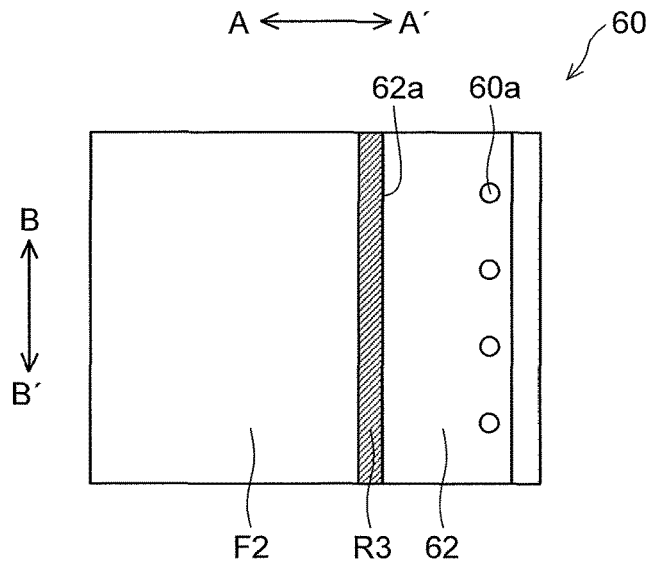
FIG. 6 is a view of the cleaning liquid supply member of the recording head, as viewed from below.

As shown in FIGS. 5 and 6, the cleaning liquid supply ports 60*a* are provided upward (wiping-direction upstream side) of a position P (e.g., central portion of the inclined surface 62 in the arrow AA' direction) in the inclined surface 62 (see FIG. 15) with which the wiper 35 makes contact during wiping operation. Also, the cleaning liquid supply ports 60*a* are placed in plurality (four in this case) at a specified pitch in a head widthwise direction (arrow BB' direction) perpendicular to the wiping direction (arrow A direction). In addition, although only one line out of the plurality of cleaning liquid supply ports 60*a* placed along the head widthwise direction are depicted in the drawings, yet a plurality of such lines may be provided in adjacency to one another in the wiping direction (arrow A direction).

Near the wiping-direction downstream end 62*a* of the inclined surface 62, a hydrophilic area R3 higher in wettability to water than the ink ejection surface F1 and the other portion (e.g., inclined surface 62 and lower surface F2) of the cleaning liquid supply member 60. The hydrophilic area R3 may also be provided in either the inclined surface 62 or the lower surface F2 only if it is near the downstream end 62*a*. In the drawings, the hydrophilic area R3 is hatched for an easier understanding.

The hydrophilic area R3 is formed so as to extend in the head widthwise direction (arrow BB' direction). Also, the hydrophilic area R3 is formed in such a strip shape as to continue over a generally entire range in the head widthwise direction near the downstream end 62*a*. Thus, as described later, when the cleaning liquid is supplied from the cleaning liquid supply ports 60*a* to the inclined surface 62, the cleaning liquid flows on the inclined surface 62 toward the downstream side (left side in FIGS. 5 and 6) and, upon reaching the hydrophilic area R3, wetly spreads in the head widthwise direction.

As a means for forming the hydrophilic area R3, available are a method including no coating with a water repellent for an area where the hydrophilic area R3 is formed, a method of forming a roughened surface for the same area, a method including coating with a hydrophilic coating agent instead of a water repellent, and the like. The hydrophilic coating agent may be, for example, titanium oxide- or polysilicate-base coating agent.

Figure 7:
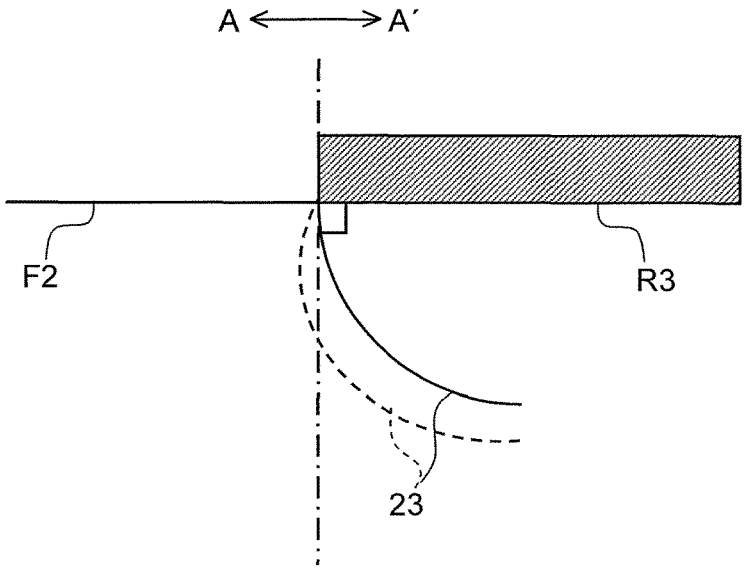
FIG. 7 is a view showing an aspect in which cleaning liquid is held at a hydrophilic area near a border between a lower surface of the cleaning liquid supply member and the hydrophilic area.

As shown in FIG. 7, given that the contact angle of the hydrophilic area R3 to water is 90° or more, aqueous cleaning liquid 23 stretches out by surface tension from the hydrophilic area R3 toward the lower surface F2 side (ink ejection surface F1 side) (depicted in broken line in FIG. 7). Therefore, the cleaning liquid 23 becomes more likely to flow toward the lower surface F2 side (ink ejection surface F1 side) due to vibrations or shocks. In a state out of later-described recovery operation for the recording head 17, the cleaning liquid 23, when having flowed to the ink ejection surface F1, may adversely affect the ink flying performance from the ink ejection nozzle 18*a*.

On the other hand, given that the contact angle of the hydrophilic area R3 to water is less than 90°, the aqueous cleaning liquid 23 does not stretch out from the hydrophilic area R3 toward the lower surface F2 side (ink ejection surface F1 side) (depicted in solid line in FIG. 7). Accordingly, it is preferable that the contact angle of the hydrophilic area R3 to water be less than 90°. Since almost all kinds of liquids are smaller in surface tension than water, setting the contact angle of the hydrophilic area R3 to water to less than 90° eliminates the possibility that the cleaning liquid 23 may flow from the hydrophilic area R3 toward the lower surface F2 side (ink ejection surface F1 side) even when the cleaning liquid 23 in use is based on a liquid other than water.

Since the cleaning liquid supply member 60 has been processed for water repellency treatment weaker than that for the ink ejection surface F1 as described before, the lower surface F2 is slightly higher in hydrophilicity than the ink ejection surface F1. Then, a neighborhood of the downstream end 62*a* of the inclined surface 62 is subjected to hydrophilic treatment, by which the hydrophilic area R3 is formed so as to be even higher in hydrophilicity. That is, given a contact angle θ1 of the ink ejection surface F1 to water, a contact angle θ2 of the lower surface F2 (cleaning liquid supply member 60) to water, and a contact angle θ3 of the hydrophilic area R3 to water, then there holds a relationship that θ1>θ2>θ3.

Figure 8:
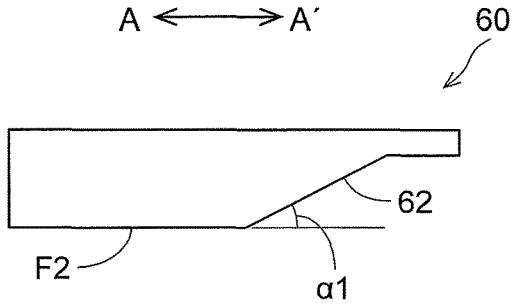
FIG. 8 is a view showing a structure of the cleaning liquid supply member.
Figure 9:
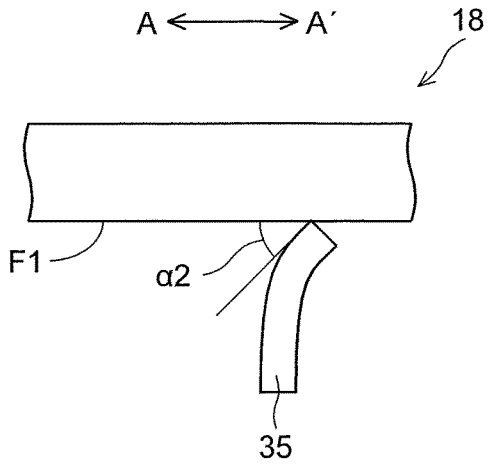
FIG. 9 is a view showing an aspect in which a wiper is moving toward arrow A direction in a state of pressure contact with the ink ejection surface.

Also, as shown in FIGS. 8 and 9, the cleaning liquid supply member 60 is so formed that the inclined surface 62 has an inclination angle al (see FIG. 8) to the ink ejection surface F1 and the lower surface F2 becomes smaller than a pressure-contact angle α2 (see FIG. 9) of a distal end portion of the wiper 35 to the ink ejection surface F1 under a state in which the wiper 35 is wiping the ink ejection surface F1. More specifically, the pressure-contact angle α2 of the distal end portion of the wiper 35 to the ink ejection surface F1 and the lower surface F2 is set to about 45°. The inclination angle α1 of the inclined surface 62 to the ink ejection surface F1 and the lower surface F2 is preferably set to an angle not less than 15° and less than 45°, more preferably to an angle not less than 30° and less than 40°.

Figure 10:
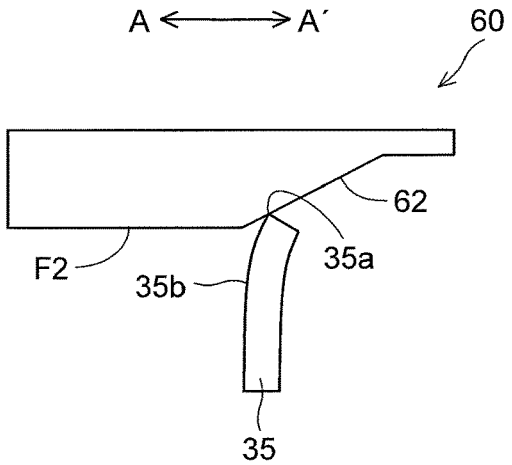
FIG. 10 is a view showing an aspect in which the wiper is moving toward the arrow A direction in a state of pressure contact with an inclined surface of the cleaning liquid supply member.

Due to the formation that the inclination angle α1 is smaller than the pressure-contact angle α2, when the wiper 35 is moved in the wiping direction (leftward direction in FIG. 10) as shown in FIG. 10, only a corner portion 35*a* of the distal end of the wiper 35 on the downstream side of the wiping direction makes contact with the inclined surface 62. That is, a side face 35*b* of the wiper 35 on the downstream side of the wiping direction does not make contact with the inclined surface 62.

The cleaning liquid supply member 60 is connected to a tank (not shown), in which the cleaning liquid 23 is housed, via a cleaning liquid supply path (not shown).

On the cleaning liquid supply path is provided a cleaning liquid supply pump (not shown) for pumping up the cleaning liquid 23 from the tank and feeding the cleaning liquid to the cleaning liquid supply member 60.

In this ink jet recording apparatus 100, with a view to cleaning the ink ejection surface F1 of the recording head 17, at a print start time after a long-time halt and during intervals of print operations, recovery operation for the recording head 17 is executed in preparation for next print operation, the recovery operation including: forcedly discharging ink from the ink ejection ports 18*a* of every recording head 17, while simultaneously feeding the cleaning liquid 23 from the cleaning liquid supply ports 60*a* (see FIG. 5) of every recording head 17 to the cleaning liquid supply area R2, to thereby wipe off the ink ejection surface F1 with the wipers 35.

Next, the recovery operation for the recording head 17 with use of the maintenance unit 19 in the ink jet recording apparatus 100 of this embodiment will be described. The recovery operation for the recording head 17 described below is executed by controlling operations of the recording head 17, the maintenance unit 19, the cleaning liquid supply pump, and the like according to control signals from the controller 110 (see FIG. 1).

Figure 11:
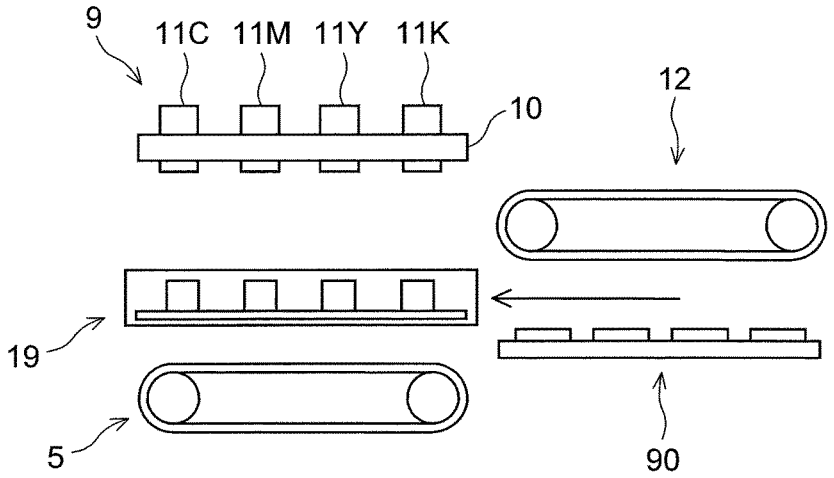
FIG. 11 is a view showing an aspect in which a maintenance unit is placed under the recording part.

For execution of the recovery operation for the recording head 17, as shown in FIG. 11, the controller 110 (see FIG. 1) first moves down the first conveyance unit 5 positioned under the recording part 9. Then, the controller 110 moves horizontally the maintenance unit 19, which is placed under the second conveyance unit 12, so that the maintenance unit 19 is placed between the recording part 9 and the first conveyance unit 5. In this state, the wiper 35 (see FIG. 14) of the maintenance unit 19 is placed below the ink ejection surface F1 and the lower surface F2 of the recording head 17 (see FIG. 14).

(Cleaning Liquid Supply Operation)

Figure 12:
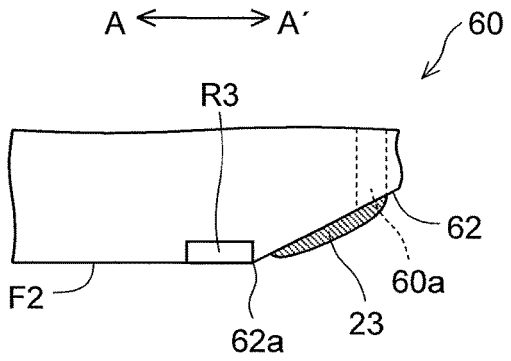
FIG. 12 is a view showing an aspect in which the cleaning liquid is flowing on the inclined surface toward the downstream side of a wiping direction.
Figure 13:
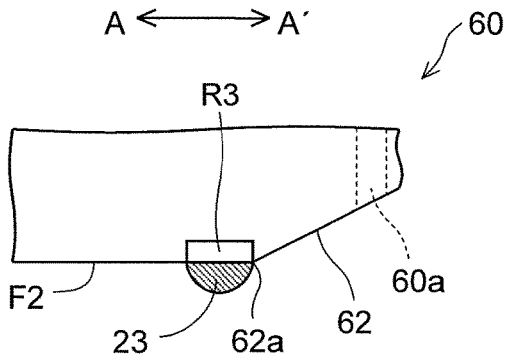
FIG. 13 is a view showing an aspect in which the cleaning liquid is held at the hydrophilic area.

Prior to wiping operation (described later), the cleaning liquid supply pump (not shown) is driven (turned on) by a control signal from the controller 110 (see FIG. 1), so that the cleaning liquid 23 is supplied to the recording head 17. In this case, the cleaning liquid 23 is supplied by a specified quantity from the cleaning liquid supply ports 60*a* to the inclined surface 62 as shown in FIG. 12. The cleaning liquid 23 supplied to the inclined surface 62 flows toward the downstream side (arrow A direction) of the wiping direction. Then, the cleaning liquid 23, upon reaching the hydrophilic area R3 provided near the downstream end 62*a* as shown in FIG. 13, wetly spreads on the hydrophilic area R3 toward the head widthwise direction, being held as it is spread over the generally entire range of the lower surface F2 in the head widthwise direction. In the figure, the cleaning liquid 23 is hatched for an easier understanding.

(Ink Purge Operation)

Figure 14:
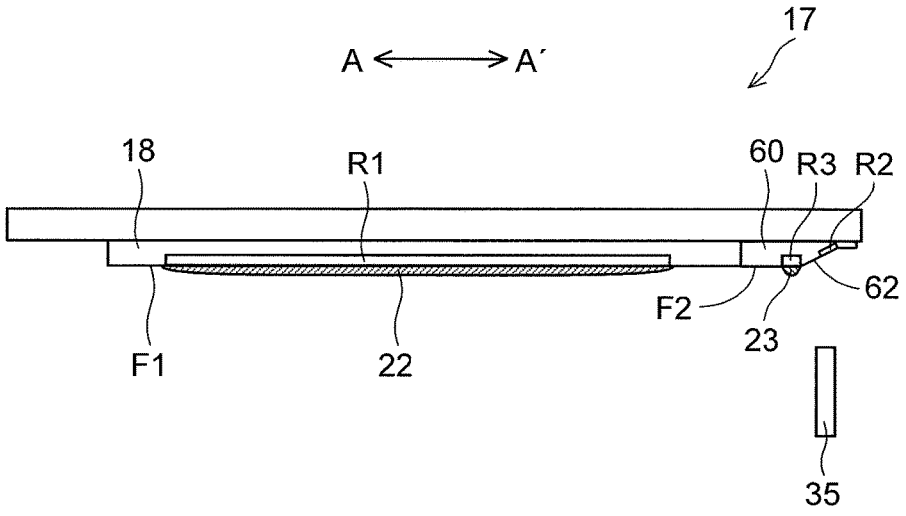
FIG. 14 is a view showing an aspect in which the wiper is placed under the recording head.

Prior to the wiping operation (described later), ink 22 is supplied to the recording head 17 by the controller 110 (see FIG. 1) as shown in FIG. 14. The supplied ink 22 is forcedly purged from the ink ejection ports 18*a*. By this purge operation, thickened ink, foreign matters and air bubbles within the ink ejection ports 18*a* are discharged from the ink ejection ports 18*a*. In this operation, the purge ink 22 is purged to the ink ejection surface F1 along the shape of the ink ejection area R1 where the ink ejection ports 18*a* are provided. In the figure, the ink (purge ink) 22 is hatched for an easier understanding.

(Wiping Operation)

Figure 15:
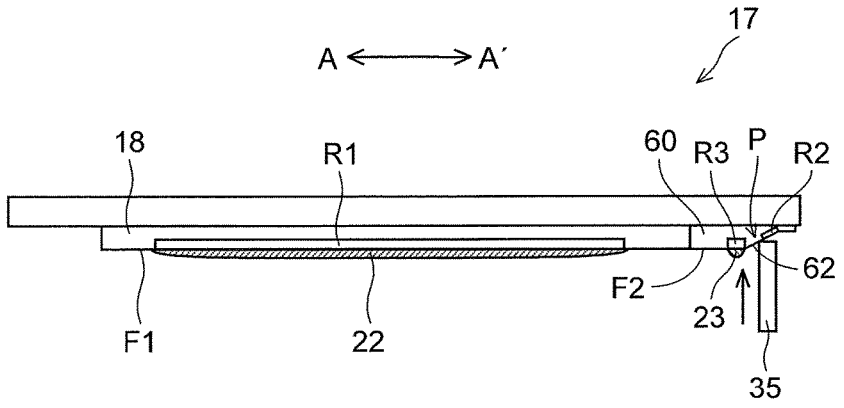
FIG. 15 is a view showing an aspect in which the wiper in the state of FIG. 14 is moved up so as to be brought into pressure contact with the cleaning liquid supply member.

The controller 110, as shown in FIG. 15, moves up the wiper 35 so that the wiper 35 is brought into contact, at a specified pressure, with the inclined surface 62 of the cleaning liquid supply member 60 in the recording head 17. In this case, the wiper 35 is moved up so that an upper surface of the wiper 35 is positioned higher than the ink ejection surface F1 and the lower surface F2 and moreover positioned lower than the cleaning liquid supply ports 60*a*. As a result of this, the wiper 35 is kept out of contact with the cleaning liquid supply ports 60*a*. In addition, at the time when the wiper 35 has been moved up, the wiper 35 does not need to be in pressure contact with the inclined surface 62. That is, the wiper 35 may be moved up while positioned rightward of the position in FIG. 15.

Figure 16:
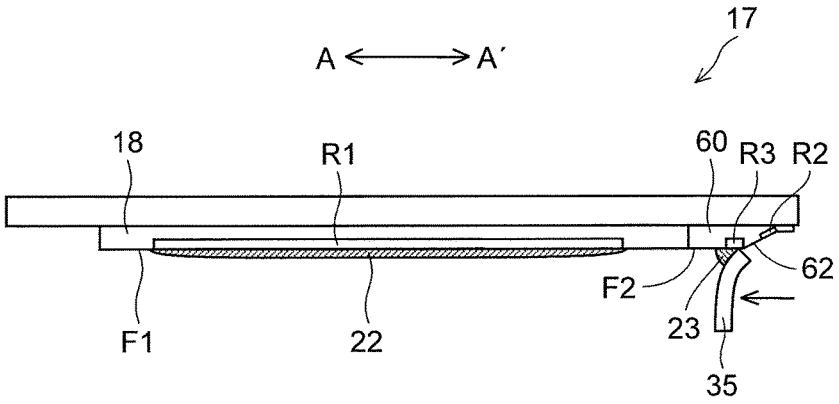
FIG. 16 is a view showing an aspect in which the wiper in the state of FIG. 15 is moved toward the arrow A direction while kept in pressure contact with the cleaning liquid supply member.

In the state in which the distal end of the wiper 35 is in pressure contact with the inclined surface 62 of the cleaning liquid supply member 60, the controller 110 moves the wiper 35 toward the ink ejection area R1 (toward the arrow A direction) along the lower surface F2 as shown in FIG. 16. As a result of this, the wiper 35 is moved toward the ink ejection area R1 while holding the cleaning liquid 23.

Figure 17:
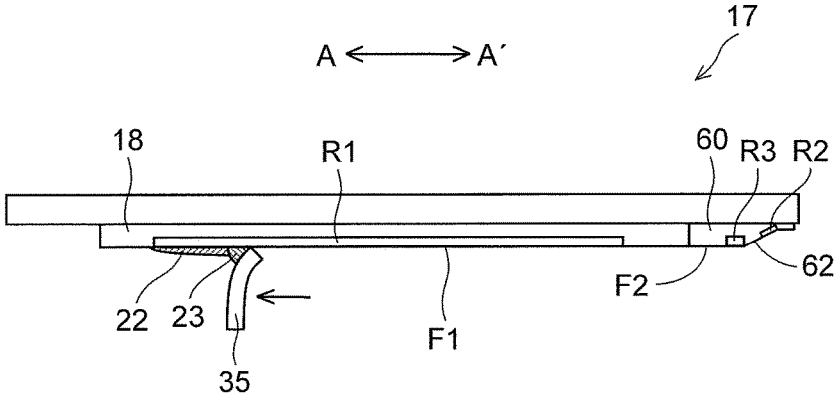
FIG. 17 is a view showing an aspect in which the wiper in the state of FIG. 16 is moved further toward the arrow A direction.

Then, as shown in FIG. 17, the wiper 35 is moved leftward (toward the arrow A direction) in the ink ejection surface F1 while continuously holding the cleaning liquid 23. In this operation, ink drops (waste ink) deposited and solidified on the ink ejection surface F1 are solved by the cleaning liquid 23 and the ink (purge ink) 22, and wiped off by the wiper 35. Then, the wiper 35 is further moved leftward (toward the arrow A direction), and then stopped from the leftward movement when having reached a position opposed to the cleaning liquid supply member 60 across the ink ejection area R1. It is noted that the cleaning liquid 23 and the waste ink wiped off by the wiper 35 are collected to a cleaning liquid collection tray (not shown) provided in the maintenance unit 19.

(Separating Operation)

Figure 18:
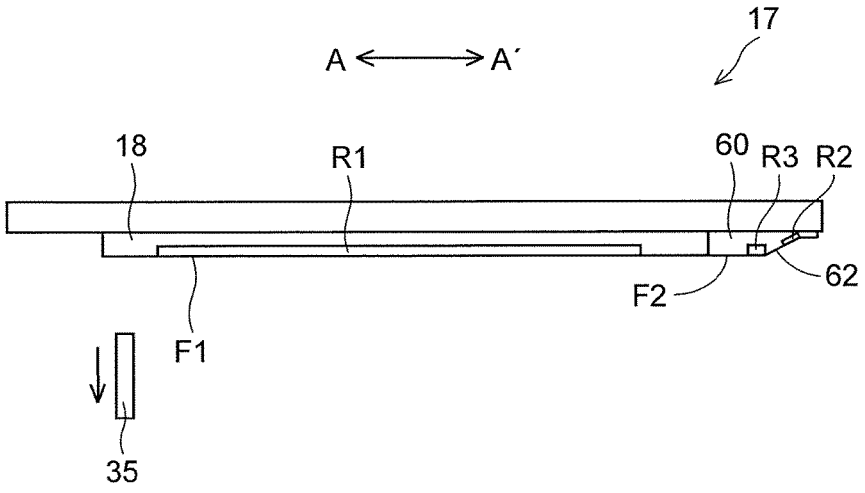
FIG. 18 is a view showing an aspect in which the wiper in the state of FIG. 17 is moved further toward the arrow A direction and thereafter moved down so as to be separated from the ink ejection surface.

After execution of the wiping operation, as shown in FIG. 18, the controller 110 moves down the wiper 35 so that the wiper 35 is separated from the ink ejection surface F1.

Finally, the controller 110 moves horizontally the maintenance unit 19 placed between the recording part 9 and the first conveyance unit 5 so that the maintenance unit 19 is placed under the second conveyance unit 12, and further the controller 110 moves up the first conveyance unit 5 to a specified position. Thus, the recovery operation for the recording head 17 is ended.

In this embodiment, as described above, the recording head 17 includes the inclined surface 62 placed on the wiping-direction upstream side of the ink ejection surface F1 and inclined downward toward the downstream side of the wiping direction. A plurality of cleaning liquid supply ports 60*a* for supplying the cleaning liquid 23 are provided in the inclined surface 62. As a result, when the cleaning liquid 23 is supplied through the cleaning liquid supply ports 60*a*, the cleaning liquid 23 flows downstream on the inclined surface 62. After the cleaning liquid 23 has reached the downstream end 62*a* of the inclined surface 62, the wiper 35 is moved along the ink ejection surface F1 from the wiping-direction upstream side of the downstream end 62*a* of the inclined surface 62. By doing so, the ink ejection surface F1 can be wiped off while the cleaning liquid 23 is being held by the wiper 35. Thus, cleaning of the ink ejection surface F1 can be achieved.

The cleaning liquid supply ports 60*a* are provided on the wiping-direction upstream side of the position P in the inclined surface 62 at which the wiper 35 makes contact therewith during the wiping operation. With this arrangement, the wiper 35 is kept out of contact with edge portions of the cleaning liquid supply ports 60*a* during the recovery operation for the recording head 17. Therefore, the distal end of the wiper 35 never rubs against the edge portions of the cleaning liquid supply ports 60*a*, so that a possibility of damage to the distal end of the wiper 35 can be suppressed.

Also as described above, the inclination angle al of the inclined surface 62 to the ink ejection surface F1 is smaller than the pressure-contact angle $\alpha 2$ of the distal end portion of the wiper 35 to the ink ejection surface F1 under the state in which the wiper 35 is wiping the ink ejection surface F1. As a result of this, the wiper 35 is prevented from flexing over the pressure-contact angle $\alpha 2$ to the ink ejection surface F1 when wiper 35 is moved in the wiping direction while kept in pressure contact with the inclined surface 62 of the recording head 17. Therefore, the wiper 35 is moved while only its corner portion 35*a* remains in contact with the inclined surface 62. That is, the side face 35*b* of the wiper 35 does not make contact with the side face (inclined surface 62) of the recording head 17. This makes it possible to suppress the possibility that the cleaning liquid 23 may remain on the inclined surface 62. As a consequence, it can be suppressed that the cleaning liquid 23 remaining on the inclined surface 62 may flow toward the ink ejection surface F1 side upon vibrations or shocks. In addition, when the cleaning liquid 23 flows to the ink ejection surface F1 under a state out of the recovery operation for the recording head 17, flying performance of the ink 22 from the ink ejection ports 18*a* may be adversely affected. Also, even though the sheet S has rubbed against the recording head 17, a possibility that the cleaning liquid 23 may stick to the sheet S can be suppressed.

As described above, the inclination angle $\alpha 1$ is not less than 15° and less than 45°. With this arrangement, the cleaning liquid 23 is allowed to easily flow toward the downstream end 62*a* of the inclined surface 62, and moreover it is made easily achievable to make only the corner portion 35*a* of the distal end of the wiper 35 put into contact the inclined surface 62.

Further as described above, the hydrophilic area R3, which is higher in wettability to water than the ink ejection surface F1, is formed near the downstream end 62*a* so as to extend in the head widthwise direction. As a result of this, the cleaning liquid 23 supplied from the cleaning liquid supply ports 60*a* and having flowed to the downstream end 62*a* of the inclined surface 62 wetly spreads across the hydrophilic area R3 in the head widthwise direction. Therefore, since it becomes possible to reduce the time duration from a start of wiping of the cleaning liquid 23 by the wiper 35 until spreading of the cleaning liquid 23 over the entire range of the head widthwise direction of the recording head 17, a possibility that non-wiped residues of the cleaning liquid 23 may be left at both end portions of the ink ejection surface F1 in the head widthwise direction can be suppressed. In addition, with the hydrophilic area R3 unprovided, driblets of the cleaning liquid 23 would coalesce into one large droplet. In this case, the cleaning liquid 23 would gather around central portion in the head widthwise direction (arrow BB' direction). Due to this, it would take long time since the cleaning liquid 23 is started to be wiped by the wiper 35 until the cleaning liquid 23 wetly spreads over the entire range of the widthwise direction (arrow BB' direction) of the wiper 35. As a consequence, in some cases, non-wiped residues of the cleaning liquid 23 may be left at both end portions of the ink ejection surface F1 in the head widthwise direction.

Also, since the cleaning liquid 23 is held spread along the hydrophilic area R3, it can be suppressed that the cleaning liquid 23 may gather around central portion in the head widthwise direction (arrow BB' direction) to be large droplets and fall from the cleaning liquid supply member 60. Thus, loss of the cleaning liquid 23 can be reduced.

Also as described above, the hydrophilic area R3 is formed over the generally entire range of the head widthwise direction near the downstream end 62*a*. As a result of this, since it becomes possible to easily reduce the time duration from when wiping of the cleaning liquid 23 is started by the wiper 35 until the cleaning liquid 23 spreads over the entire range of the head widthwise direction across the recording head 17, it can be easily suppressed that non-wiped residues of the cleaning liquid 23 may be left at both end portions of the ink ejection surface F1 in the head widthwise direction.

Also as described above, the hydrophilic area R3 is formed into such a strip shape as to continue over the generally entire range of the head widthwise direction near the downstream end 62*a*. As a result of this, for example, the cleaning liquid 23 that has flowed up to central portion in the head widthwise direction can be wetly spread to both end portions of the head widthwise direction with simplicity.

Also as described above, given a contact angle $\theta 1$ of the ink ejection surface F1 to water, a contact angle $\theta 2$ of the cleaning liquid supply member 60 to water, and a contact angle $\theta 3$ of the hydrophilic area R3 to water, then the relationship that $\theta 1 > \theta 2 > \theta 3$ is satisfied. As a result of this, the wettability of the hydrophilic area R3 to water (cleaning liquid 23 in this case) can be made high enough. Further, it can be suppressed to more extent that the cleaning liquid 23 may flow to the ink ejection surface F1 upon vibrations or shocks.

Also as described above, the inclined surface 62 is subjected to water repellency treatment. As a result of this, it can be suppressed that the cleaning liquid 23 supplied from the cleaning liquid supply ports 60*a* and flowing on the inclined surface 62 toward its downstream end 62*a* may stay halfway on the inclined surface 62. Therefore, it can be suppressed that the cleaning liquid 23 remaining halfway on the inclined surface 62 may flow to the downstream end 62*a* of the inclined surface 62 due to vibrations or shocks under a state out of the recovery operation for the recording head 17. As a result of this, even though the sheet S has rubbed against the recording head 17, the possibility that the cleaning liquid 23 may stick to the sheet S can be suppressed. Further, it can be suppressed that the cleaning liquid 23 may flow to the ink ejection surface F1 so as to adversely affect the flying performance of the ink 22 from the ink ejection ports 18*a*.

Second Embodiment

Figure 19:
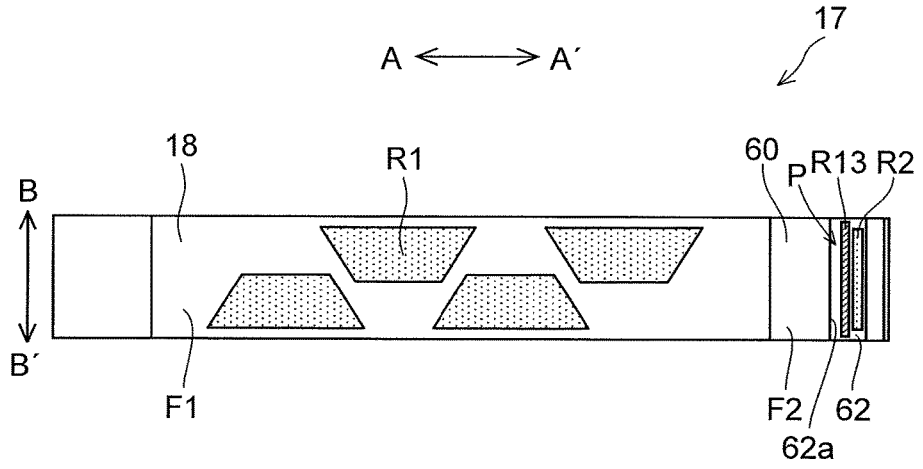
FIG. 19 is a view of a recording head according to a second embodiment of the disclosure, as viewed from the ink ejection surface side.
Figure 20:
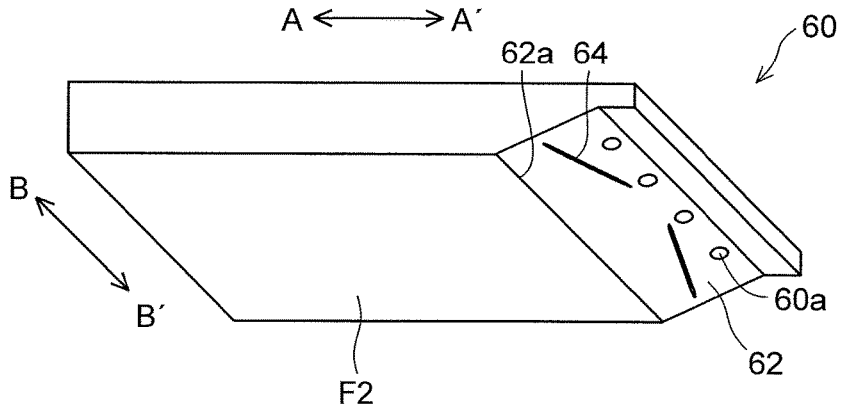
FIG. 20 is a view of a cleaning liquid supply member of the recording head in the second embodiment of the disclosure, as viewed from obliquely below.
Figure 21:
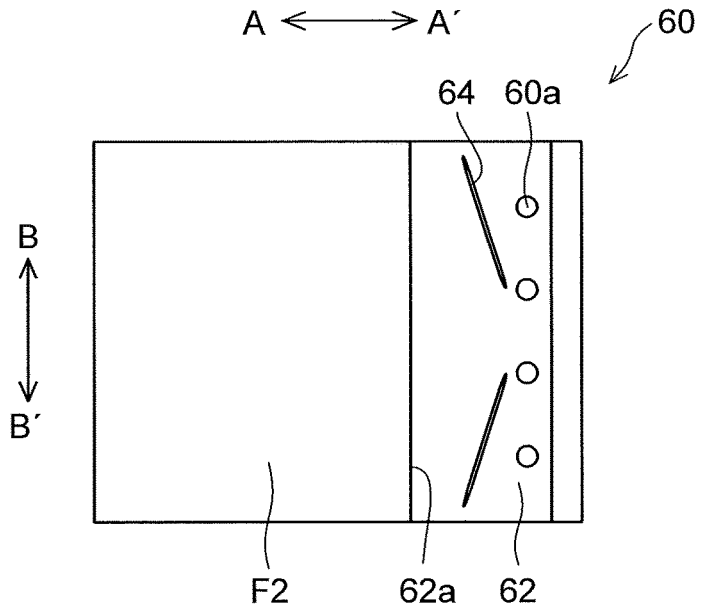
FIG. 21 is a view of the cleaning liquid supply member of the recording head in the second embodiment of the disclosure, as viewed from below.

In an ink jet recording apparatus 100 according to a second embodiment of the disclosure, as shown in FIGS. 19 to 21, the cleaning liquid supply ports 60*a* are provided upward (upstream side of the wiping direction) of a position P (e.g., near the downstream end 62*a*) in the inclined surface 62 (see FIGS. 19 and 24) with which the wiper 35 makes contact during wiping operation. In addition, although only four cleaning liquid supply ports 60*a* are depicted in the figures for drawing simplification, a plurality of about 10 to 20 cleaning liquid supply ports 60*a* are provided actually.

In this embodiment, the hydrophilic area R3 is not provided unlike the first embodiment.

The inclined surface 62 includes a groove-formation area R13 (see FIG. 19) in which one or more (two in this case) grooves 64 are formed so as to be recessed relative to the inclined surface 62. Each groove 64 is set to a depth of, e.g., 0.1 mm to 0.5 mm. The grooves 64 are provided at a site in the inclined surface 62 which is on the wiping-direction downstream side of the cleaning liquid supply ports 60*a* and moreover on the wiping-direction upstream side of the position P with which the wiper 35 makes contact during wiping operation.

The grooves 64 are formed with such an inclination relative to the wiping direction that the grooves 64 extend outward of the head widthwise direction as the grooves 64 extend downward more and more in the wiping direction. The grooves 64 are provided in plurality (two in this case) with a specified distance from each other in the head widthwise direction. The grooves 64 are formed so as to extend outward of the cleaning liquid supply ports 60*a* in the head widthwise direction and moreover extend up to near both end portions of the inclined surface 62 in the head widthwise direction. As a result of this, as described later, when the cleaning liquid is supplied from the cleaning liquid supply ports 60*a* to the inclined surface 62, part of the cleaning liquid flows along the grooves 64 toward the downstream side (left side in FIGS. 20 and 21) in the inclined surface 62 such that the cleaning liquid is spread in the head widthwise direction at the downstream end 62*a* of the inclined surface 62.

The other structures of the second embodiment are the same as in the first embodiment.

Next, the recovery operation for the recording head 17 using the maintenance unit 19 in the ink jet recording apparatus 100 of this embodiment will be described.

For execution of the recovery operation for the recording head 17, the controller 110 (see FIG. 1) first moves down the first conveyance unit 5 positioned under the recording part 9 as shown in FIG. 11. Then, the controller 110 moves horizontally the maintenance unit 19, which is placed under the second conveyance unit 12, so that the maintenance unit 19 is placed between the recording part 9 and the first conveyance unit 5.

(Cleaning Liquid Supply Operation)

Figure 22:
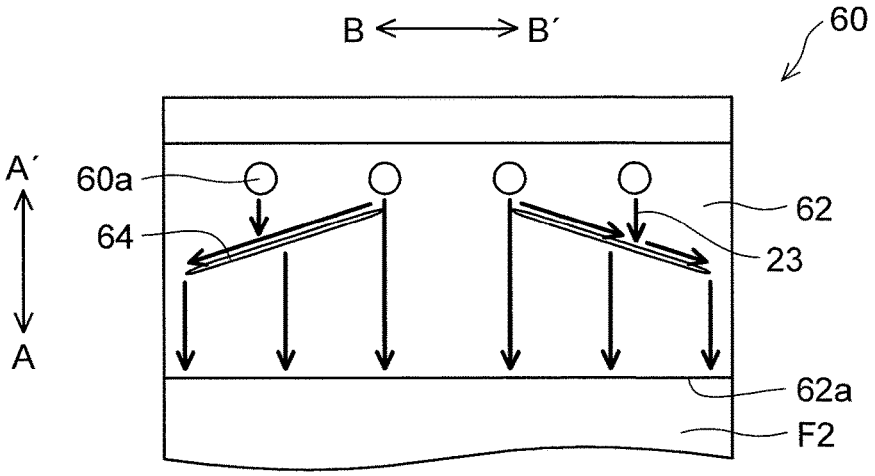
FIG. 22 is a view showing an aspect in which the cleaning liquid is flowing on the inclined surface toward the downstream side of the wiping direction in the recording head of the second embodiment of the disclosure.

Prior to the wiping operation (described later), the cleaning liquid supply pump (not shown) is driven (turned on) by a control signal from the controller 110 (see FIG. 1), by which the cleaning liquid is supplied to the recording head 17. In this case, the cleaning liquid is supplied by a specified quantity through the cleaning liquid supply ports 60*a* to the inclined surface 62. As shown in FIG. 22, the cleaning liquid 23 supplied to the inclined surface 62 flows on the inclined surface 62 toward the downstream side (toward arrow A direction) in the wiping direction. Then, part of the cleaning liquid 23, upon reaching the grooves 64, flows along the grooves 64 outward of the head widthwise direction. Also, part of the cleaning liquid 23 flowing along the grooves 64 flows beyond the grooves 64 to the downstream side of the wiping direction. In this way, the cleaning liquid 23 supplied through the cleaning liquid supply ports 60*a*, which are provided by a quantity of, e.g., 10 to 20 pieces, flows down on the inclined surface 62 while repeatedly merging together and getting beyond the grooves 64. As a result, the cleaning liquid 23 is held as it is spread over a generally entire range of the head widthwise direction near the downstream end 62*a*. In FIG. 22, the flowing state of the cleaning liquid 23 is indicated by thick-line arrows for an easier understanding.

(Ink Purge Operation)

Figure 23:
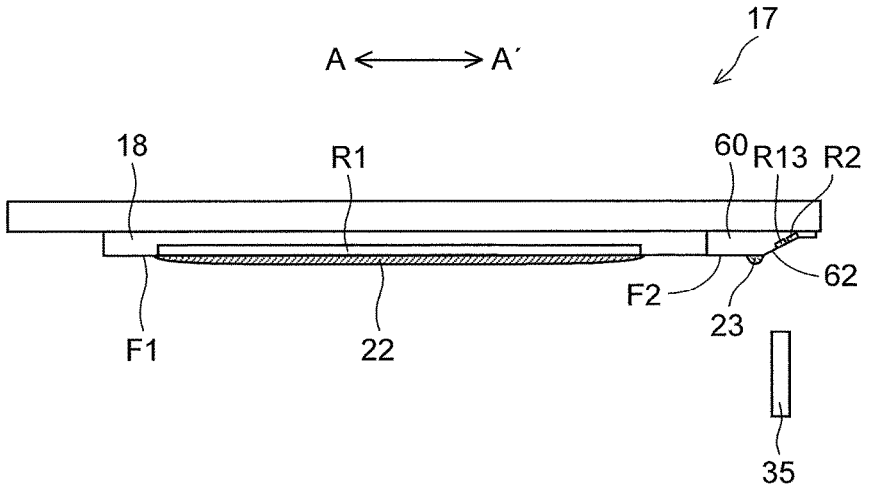
FIG. 23 is a view showing a state of the recording head in the second embodiment of the disclosure in which the wiper is placed under the recording head.

Prior to the wiping operation (described later), as shown in FIG. 23, the ink 22 is supplied to the recording head 17 by the controller 110 (see FIG. 1). The supplied ink 22 is forcedly purged from the ink ejection ports 18*a*.

(Wiping Operation)

Figure 24:
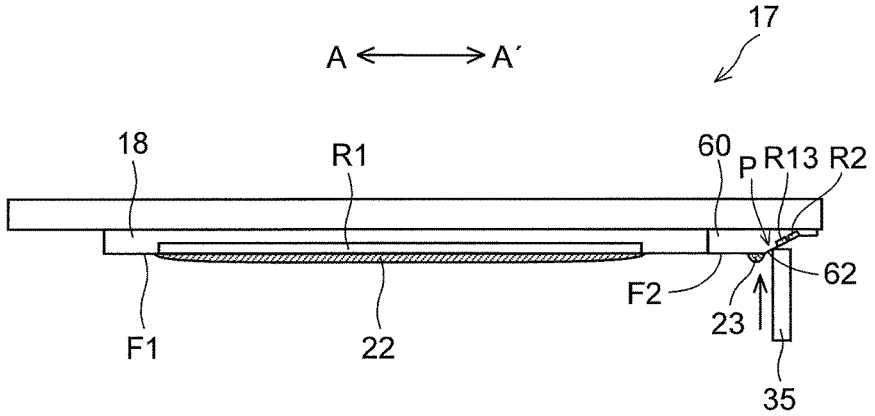
FIG. 24 is a view showing an aspect in which the wiper in the state of FIG. 23 is moved up so as to be brought into pressure contact with the cleaning liquid supply member.

As shown in FIG. 24, the controller 110 moves up the wiper 35 so that the wiper 35 is brought into contact, at a specified pressure, with the inclined surface 62 of the cleaning liquid supply member 60 in the recording head 17. In this case, the wiper 35 is moved up so that the upper surface of the wiper 35 is positioned higher than the ink ejection surface F1 and the lower surface F2 and moreover positioned lower than the grooves 64 and the cleaning liquid supply ports 60*a*. As a result of this, the wiper 35 is kept out of contact with the grooves 64 and the cleaning liquid supply ports 60*a*. In addition, at the time when the wiper 35 has been moved up, the wiper 35 does not need to be in pressure contact with the inclined surface 62. That is, the wiper 35 may be moved up while positioned rightward of the position in FIG. 24.

Figure 25:
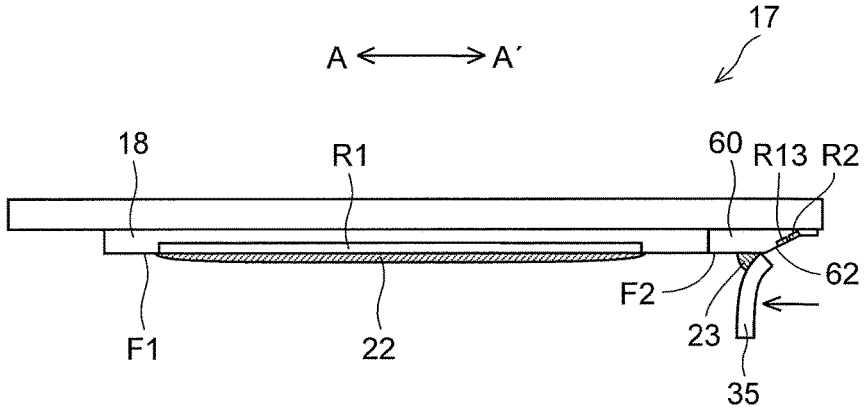
FIG. 25 is a view showing an aspect in which the wiper in the state of FIG. 24 is moved toward the arrow A direction while kept in pressure contact with the cleaning liquid supply member.

In the state that the distal end of the wiper 35 is in pressure contact with the inclined surface 62 of the cleaning liquid supply member 60, the controller 110 moves the wiper 35 along the lower surface F2 toward the ink ejection area R1 (toward the arrow A direction) as shown in FIG. 25. As a result of this, the wiper 35 is moved toward the ink ejection area R1 while holding the cleaning liquid 23.

Figure 26:
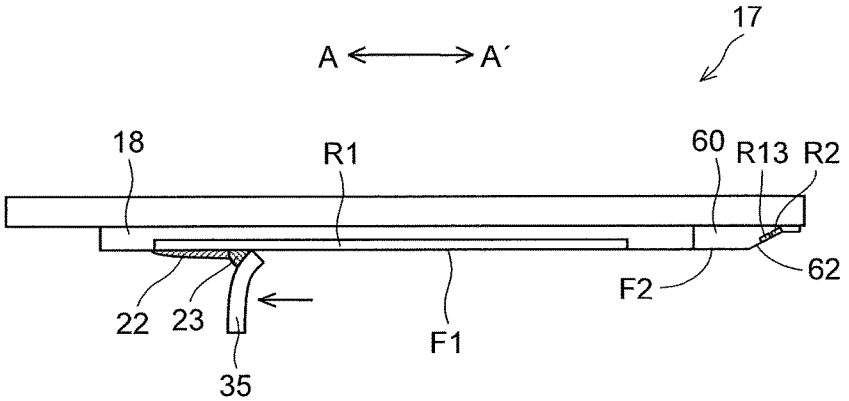
FIG. 26 is a view showing an aspect in which the wiper in the state of FIG. 25 is moved further toward the arrow A direction.

Then, as shown in FIG. 26, the wiper 35 is moved leftward (toward the arrow A direction) in the ink ejection surface F1 while continuously holding the cleaning liquid 23. Then, the wiper 35 is moved further leftward (toward the arrow A direction) and, upon reaching a position opposed to the cleaning liquid supply member 60 across the ink ejection area R1, is stopped from the leftward movement.

(Separating Operation)

Figure 27:
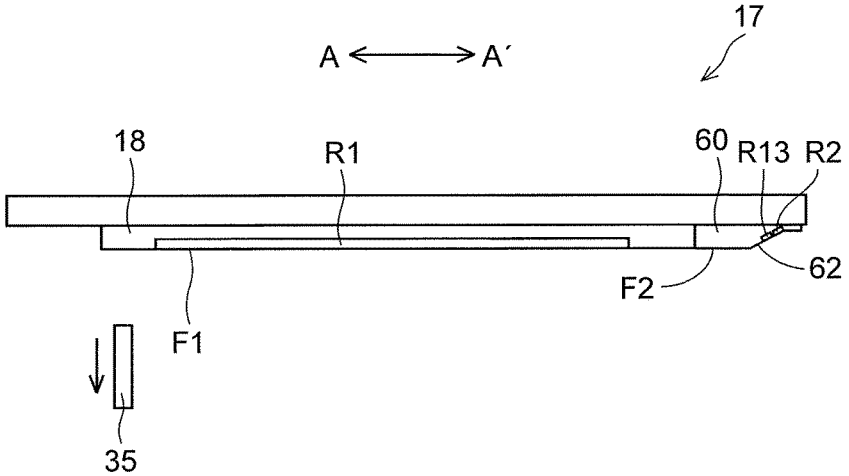
FIG. 27 is a view showing an aspect in which the wiper in the state of FIG. 26 is moved further toward the arrow A direction and thereafter moved down so as to be separated from the ink ejection surface.

After execution of the wiping operation, the controller 110 moves down the wiper 35 so that the wiper 35 is separated from the ink ejection surface F1 as shown in FIG. 27.

Finally, the controller 110 moves horizontally the maintenance unit 19, which is placed between the recording part 9 and the first conveyance unit 5, so that the maintenance unit 19 is placed under the second conveyance unit 12, and further the controller 110 moves up the first conveyance unit 5 to a specified position. Thus, the recovery operation for the recording head 17 is ended.

The other operations of the second embodiment are the same as in the first embodiment.

In this embodiment, as described above, the grooves 64, which extend outward of the head widthwise direction while extending downward more and more in the wiping direction, are formed on the wiping-direction downstream side of the cleaning liquid supply ports 60*a* in the inclined surface 62. As a result of this, the cleaning liquid 23, when flowing toward the downstream side in the inclined surface 62, spreads along the grooves 64 outward of the head widthwise direction. Therefore, since it becomes possible to reduce the time duration from when wiping of the cleaning liquid 23 is started by the wiper 35 until the cleaning liquid 23 spreads over the entire range of the head widthwise direction in the recording head 17, a possibility that non-wiped residues of the cleaning liquid 23 are left at both end portions of the ink ejection surface F1 in the head widthwise direction can be suppressed. In addition, with the grooves 64 unprovided, driblets of the cleaning liquid 23 would be more likely to coalesce into one large droplet. In this case, the cleaning liquid 23 would gather around central portion in the head widthwise direction. Due to this, it would take long time since the cleaning liquid 23 is started to be wiped by the wiper 35 until the cleaning liquid 23 spreads over the entire range of the widthwise direction of the wiper 35. As a consequence, in some cases, non-wiped residues of the cleaning liquid 23 may be left at both end portions of the ink ejection surface F1 in the head widthwise direction.

Also as described above, the grooves 64 are formed up to near both end portions of the inclined surface 62 in the head widthwise direction. Therefore, since it becomes possible to reduce the time duration from when wiping of the cleaning liquid 23 is started by the wiper 35 until the cleaning liquid 23 spreads over the entire range in the head widthwise direction of the recording head 17, it can be suppressed to more extent that non-wiped residues of the cleaning liquid 23 may be left at both end portions of the ink ejection surface F1 in the head widthwise direction.

Also as described above, the grooves 64 are provided in plurality with a specified distance from each other or one another in the head widthwise direction. As a result of this, the cleaning liquid 23 flows through central portion as well as near both end portions of the inclined surface 62 in the head widthwise direction, so that quantity of the cleaning liquid 23 in the head widthwise direction can be uniformized.

Also as described above, the grooves 64 are provided on the wiping-direction upstream side of the position P in the inclined surface 62 with which the wiper 35 makes contact during wiping operation. With this arrangement, the wiper 35 is kept out of contact with edge portions of the grooves 64 during the recovery operation for the recording head 17. Therefore, since the distal end of the wiper 35 never rubs against the edge portions of the grooves 64, a possibility of damage to the distal end of the wiper 35 can be suppressed to more extent.

Also as described above, the depth of the grooves 64 is within a range of 0.1 mm to 0.5 mm. As a result of this, it becomes possible to let the cleaning liquid 23 easily flow along the grooves 64 as well as to suppress remaining of the cleaning liquid 23 inside the grooves 64.

Also as described above, the recording head 17 is composed of the head portion 18 having the ink ejection surface F1, and the cleaning liquid supply member 60 having the inclined surface 62 and the lower surface F2. As a result of this, the inclined surface 62 and the grooves 64 can be formed with more simplicity, as compared with the case where the inclined surface 62 and the grooves 64 are formed in the head portion 18.

The other effects of the second embodiment are the same as in the first embodiment.

Third Embodiment

Figure 28:
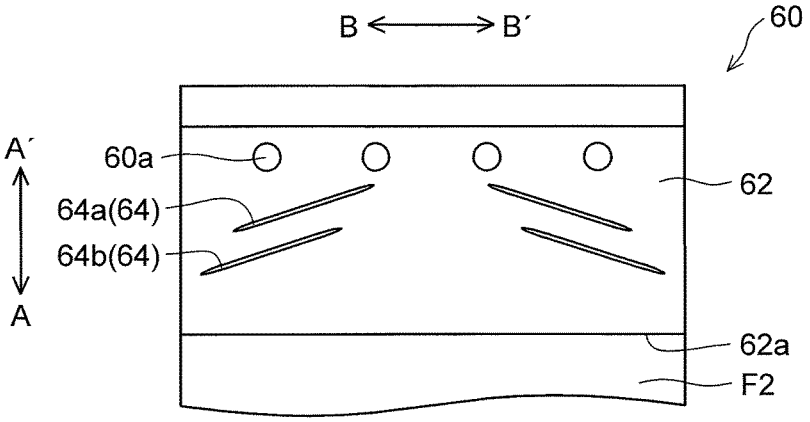
FIG. 28 is a view of a cleaning liquid supply member according to a third embodiment of the disclosure, as viewed from below.

In the cleaning liquid supply member 60 of an ink jet recording apparatus 100 according to a third embodiment of the disclosure, the grooves 64 are provided by four pieces as shown in FIG. 28.

The grooves 64 are formed with such an inclination relative to the wiping direction that the grooves 64 extend outward of the head widthwise direction as the grooves 64 extend toward the downstream side more and more in the wiping direction. The grooves 64 are provided in plurality (two for each array in this case) with a specified distance between the arrays in the head widthwise direction.

The grooves 64 include upstream-side grooves 64*a* placed on the upstream side of the wiping direction, and downstream-side grooves 64*b* placed on the downstream side of the wiping direction. The upstream-side grooves 64*a* and the downstream-side grooves 64*b* are provided independently of each other in the wiping direction, and placed so as to overlap with each other in the head widthwise direction (arrow BB' direction). The downstream-side grooves 64*b* are placed so as to be shifted outward of the upstream-side grooves 64*a* in the head widthwise direction, and formed up to near both end portions of the inclined surface 62 in the head widthwise direction.

Figure 29:
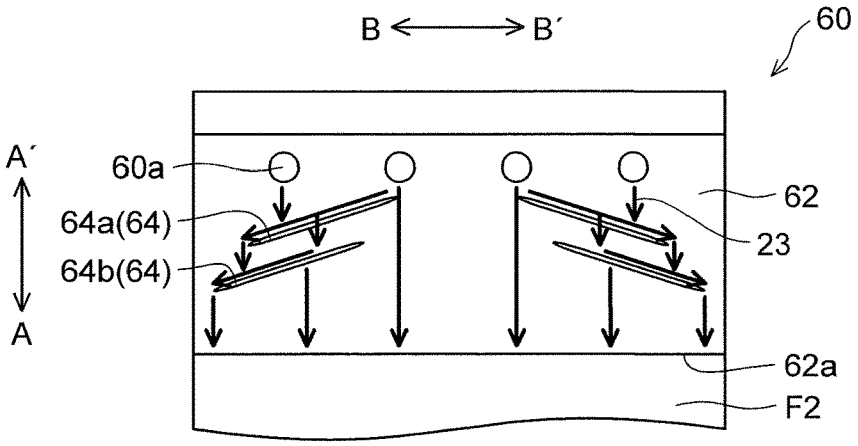
FIG. 29 is a view showing an aspect in which cleaning liquid is flowing toward the downstream side of the wiping direction on an inclined surface of the cleaning liquid supply member of the third embodiment of the disclosure.

As a result, as shown in FIG. 29, when the cleaning liquid 23 is supplied from the cleaning liquid supply ports 60*a* to the inclined surface 62, part of the cleaning liquid 23 flows along the upstream-side grooves 64*a* toward the downstream side (lower side in FIG. 29) on the inclined surface 62, and moreover at least part (all in the case of FIG. 29) of the cleaning liquid 23 having got beyond the upstream-side grooves 64*a* also flows along the downstream-side grooves 64*b* toward the downstream side on the inclined surface 62. Therefore, at the downstream end 62*a* of the inclined surface 62, the cleaning liquid 23 is more likely to gather on the outer side of the head widthwise direction, as compared with the second embodiment.

In addition, quantity and ratio of the cleaning liquid 23 that goes beyond the grooves 64 are regulatable depending on depth of the grooves 64, width of the grooves 64, inclination angle al of the inclined surface 62, quantity of the cleaning liquid 23 supplied to the inclined surface 62, inclination angle of the grooves 64 to the wiping direction, and the like. This is similarly applicable also to the other embodiments.

The other structures and operations of the third embodiment are the same as in the second embodiment.

In this embodiment, as described above, the grooves 64 include the upstream-side grooves 64*a* and the downstream-side grooves 64*b* provided independently of each other in the wiping direction, and the upstream-side grooves 64*a* and the downstream-side grooves 64*b* are placed so as to overlap with each other in the head widthwise direction. As a result of this, the cleaning liquid 23 that has got beyond the upstream-side grooves 64*a* can be directed (led) more effectively toward the outer side of the head widthwise direction by the downstream-side grooves 64*b*.

The other effects of the third embodiment are the same as in the second embodiment.

Fourth Embodiment

Figure 30:
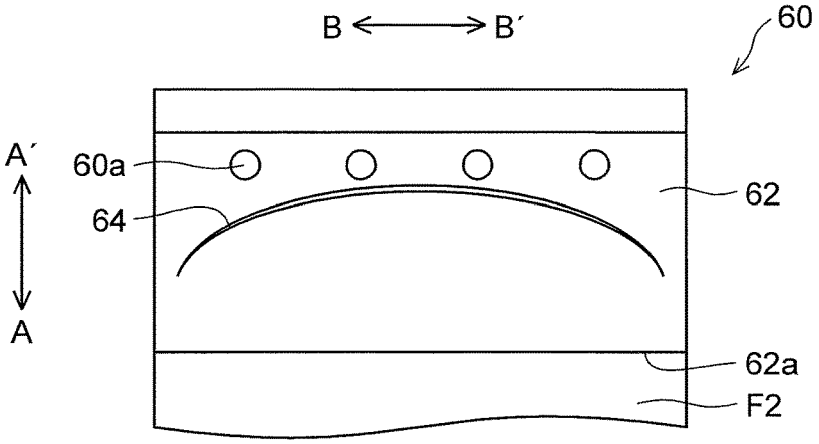
FIG. 30 is a view of a cleaning liquid supply member according to a fourth embodiment of the disclosure, as viewed from below.

In the cleaning liquid supply member 60 of an ink jet recording apparatus 100 according to a fourth embodiment of the disclosure, as shown in FIG. 30, the groove 64 is provided only one in quantity.

The groove 64 is formed with such an inclination relative to the wiping direction that the groove 64 extends outward of the head widthwise direction as the groove 64 extends more and more toward the downstream side of the wiping direction. The groove 64 is formed so as to continue in the head widthwise direction and, in this case, formed into an inverted-U shape. The groove 64 may also be formed into an inverted-V shape.

Figure 31:
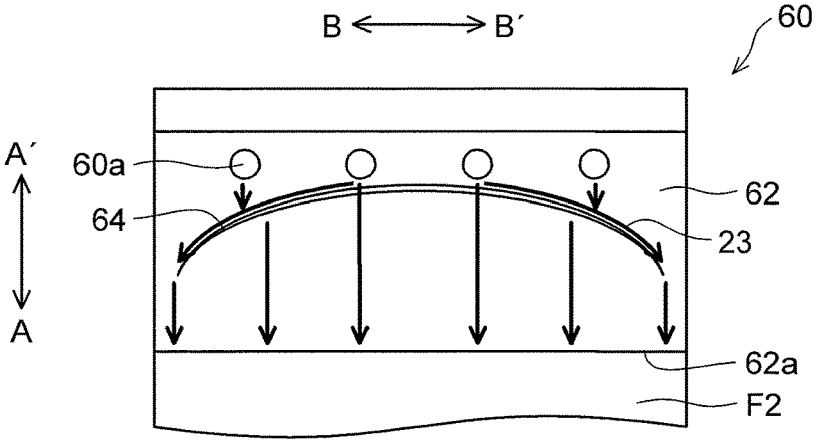
FIG. 31 is a view showing an aspect in which the cleaning liquid is flowing toward the downstream side of the wiping direction on an inclined surface of the cleaning liquid supply member of the fourth embodiment of the disclosure.

With this arrangement, when the cleaning liquid 23 is supplied from the cleaning liquid supply ports 60*a* to the inclined surface 62 as shown in FIG. 31, the cleaning liquid 23 flows toward the downstream side (lower side in FIG. 31) on the inclined surface 62, so that all of the cleaning liquid 23 reaches the groove 64. Then, part of the cleaning liquid 23 flows along the groove 64 toward the downstream side on the inclined surface 62, while the rest of the cleaning liquid 23 goes beyond the groove 64 and flows toward the downstream side of the inclined surface 62. Therefore, at the downstream end 62*a* of the inclined surface 62, the cleaning liquid 23 is more likely to gather on the outer side of the head widthwise direction, as compared with the second embodiment.

The other structures and operations of the fourth embodiment are the same as in the second embodiment.

In this embodiment, as described above, the groove 64 is formed so as to continue in the head widthwise direction. As a result of this, part of the cleaning liquid 23 that has flowed up to central portion of the head widthwise direction, as an example, can be easily led to both end portions of the head widthwise direction.

The other effects of the fourth embodiment are the same as in the second embodiment.

Fifth Embodiment

Figure 32:
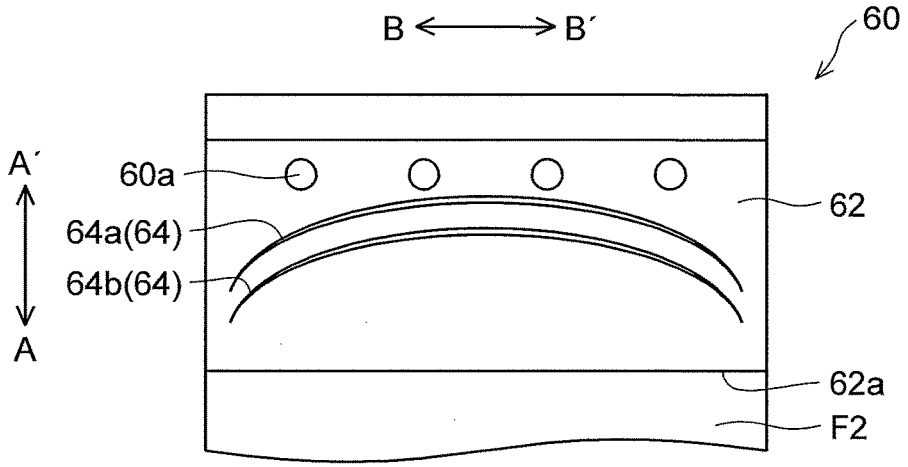
FIG. 32 is a view of a cleaning liquid supply member according to a fifth embodiment of the disclosure, as viewed from below.

In the cleaning liquid supply member 60 of an ink jet recording apparatus 100 according to a fifth embodiment of the disclosure, as shown in FIG. 32, the groove 64 having the same structure as in the fourth embodiment is provided two in number.

The grooves 64 include an upstream-side groove 64*a* placed on the upstream side of the wiping direction, and a downstream-side groove 64*b* placed on the downstream side of the wiping direction. The upstream-side groove 64*a* and the downstream-side groove 64*b* are provided independently of each other in the wiping direction, and placed so as to overlap with each other in the head widthwise direction (arrow BB' direction).

Figure 33:
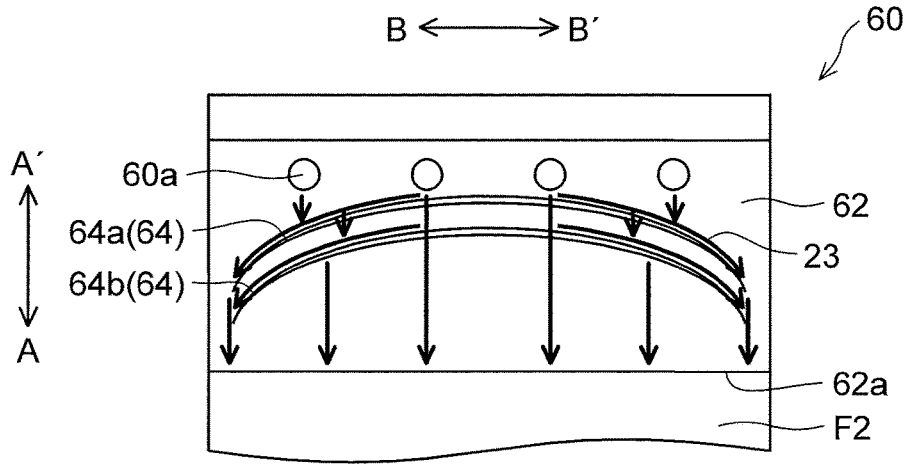
FIG. 33 is a view showing an aspect in which the cleaning liquid is flowing toward the downstream side of the wiping direction on an inclined surface of the cleaning liquid supply member of the fifth embodiment of the disclosure.

With this arrangement, when the cleaning liquid 23 is supplied from the cleaning liquid supply ports 60*a* to the inclined surface 62 as shown in FIG. 33, the cleaning liquid 23 flows toward the downstream side (lower side in FIG. 33) on the inclined surface 62, so that all of the cleaning liquid 23 reaches the upstream-side groove 64*a*. Then, part of the cleaning liquid 23 flows along the upstream-side groove 64*a* toward the downstream side on the inclined surface 62, while the rest of the cleaning liquid 23 goes beyond the upstream-side groove 64*a* and reaches the downstream-side groove 64*b*. Part of the cleaning liquid 23 having reached the downstream-side groove 64*b* flows along the downstream-side groove 64*b* toward the downstream side on the inclined surface 62, while the rest of the cleaning liquid 23 having reached the downstream-side groove 64*b* goes beyond the downstream-side groove 64*b* and flows toward the downstream side on the inclined surface 62. Therefore, at the downstream end 62*a* of the inclined surface 62, the cleaning liquid 23 is more likely to gather on the outer side of the head widthwise direction, as compared with the second to fourth embodiments.

The other structures and operations of the fifth embodiment are the same as in the fourth embodiment.

The effects of the fifth embodiment are the same as in the third and fourth embodiments.

The embodiments disclosed herein should be construed as not being limitative but being an exemplification at all points. The scope of the disclosure is defined not by the above description of the embodiments but by the appended claims, including all changes and modifications equivalent in sense and range to the claims.

For example, the foregoing embodiments have been described on a case in which the cleaning liquid supply member 60 with the inclined surface 62 and the cleaning liquid supply ports 60*a* formed therein is provided independently of the head portion 18, but the present disclosure is not limited to this. With no cleaning liquid supply member 60 provided, the inclined surface 62 and the cleaning liquid supply ports 60*a* may be formed in the head portion 18.

Figure 34:
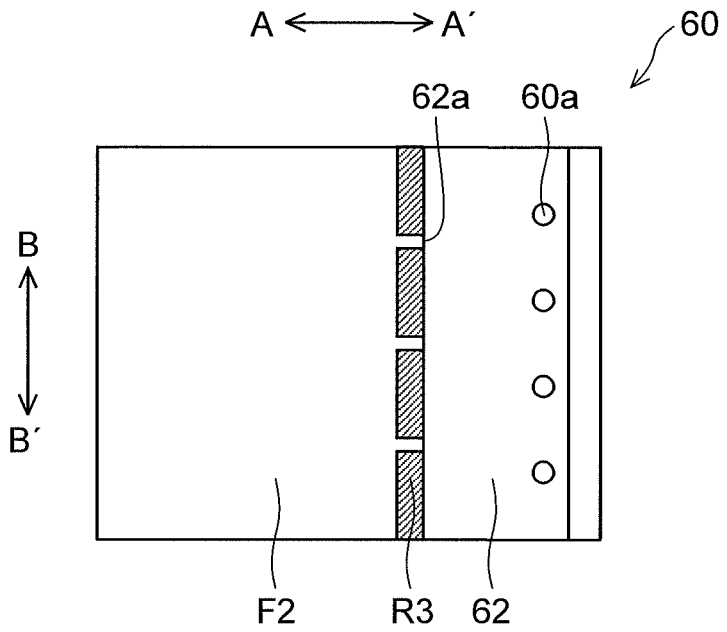
FIG. 34 is a view of a cleaning liquid supply member of a recording head which is a modification of the first embodiment of the disclosure, as viewed from below.

Also, the first embodiment has been described on a case in which the hydrophilic area R3 is formed in such a strip shape as to continue over the generally entire range of the head widthwise direction near the downstream end 62*a*, but the present disclosure is not limited to this. As in the case of a cleaning liquid supply member 60 of a recording head 17 shown in FIG. 34, which is a modification of the first embodiment of the disclosure, a plurality of hydrophilic areas R3 may be provided independently (segmentally) of each other or one another in the head widthwise direction. With this arrangement, gathering of the cleaning liquid 23 around central portion in the head widthwise direction (arrow BB' direction) can be suppressed with simplicity. Also, a plurality of hydrophilic areas R3 may be provided in adjacency to one another in the wiping direction. Further, the hydrophilic area R3 may be formed into a shape other than rectangular (strip) shapes.

Also, the second to fifth embodiments have been described on a case in which the grooves 64 are provided on the wiping-direction upstream side of the position P in the inclined surface 62 with which the wiper 35 makes contact during the wiping operation. However, the present disclosure not being limited to this, the grooves 64 may be provided so as to overlap the position P in the inclined surface 62 with which the wiper 35 makes contact during the wiping operation. However, in order to suppress the possibility of damage to the distal end of the wiper 35, it is preferable that the wiper 35 be prevented as much as possible from making contact with the grooves 64, or that edge portions of the grooves 64 be formed into curved surfaces.

Further, the foregoing embodiments have been described on a case in which the recovery operation for the recording head 17 is executed with use of the cleaning liquid 23 and the ink (purge ink) 22. However, the recovery operation for the recording head 17 may be executed with use of the cleaning liquid 23 alone. That is, the ink purge operation does not necessarily need to be executed.

Configurations obtained by combining configurations of the above-described embodiments and modifications as required should also be construed as being included in the technical scope of the present disclosure.

What is claimed is:

1. A head cleaning mechanism comprising:

a recording head including an ink ejection surface in which an ink ejection area is provided, the ink ejection area having a plurality of ink ejection ports opened therein for ejecting ink onto a recording medium; and a wiper for wiping the ink ejection surface in a specified direction, wherein the recording head includes an inclined surface placed on an upstream side of the ink ejection surface in a wiping direction that is a direction in which the wiper wipes the ink ejection surface, the inclined surface being inclined downward toward a downstream side of the wiping direction, and a plurality of cleaning liquid supply ports for supplying cleaning liquid are provided on a wiping-direction upstream side of a position in the inclined surface with which the wiper makes contact during wiping operation.

2. The head cleaning mechanism according to claim 1, wherein an inclination angle of the inclined surface to the ink ejection surface is smaller than a pressure-contact angle of a distal end portion of the wiper to the ink ejection surface under a state that the wiper is wiping the ink ejection surface.

3. The head cleaning mechanism according to claim 2, wherein the inclination angle is not less than 15° and less than 45°.

4. The head cleaning mechanism according to claim 1, wherein near a downstream end of the inclined surface in the wiping direction, a hydrophilic area higher in wettability to water than the ink ejection surface is formed so as to extend in a head widthwise direction perpendicular to the wiping direction.

5. The head cleaning mechanism according to claim 4, wherein the hydrophilic area is formed over a generally entire range of the head widthwise direction near the downstream end.

6. The head cleaning mechanism according to claim 5, wherein the hydrophilic area is formed in such a strip shape as to continue over a generally entire range of the head widthwise direction near the downstream end.

7. The head cleaning mechanism according to claim 5, wherein the hydrophilic area is provided in plurality independently of each other or one another in the head widthwise direction.

8. The head cleaning mechanism according to claim 4, wherein the recording head comprises:

an ink ejection head portion having the ink ejection surface; and a cleaning-liquid supply head portion having the inclined surface, and a lower surface extending from the downstream end of the inclined surface toward the ink ejection surface, wherein given a contact angle $\theta 1$ of the ink ejection surface to water, a contact angle $\theta 2$ of the cleaning-liquid supply head portion to water, and a contact angle $\theta 3$ of the hydrophilic area to water, then a relationship that $\theta 1 > \theta 2 > \theta 3$ is satisfied.

9. The head cleaning mechanism according to claim 1, wherein on one side of the inclined surface downstream of the cleaning liquid supply ports in the wiping direction, such a groove is formed as to extend outward of a head widthwise direction perpendicular to the wiping direction as the groove extends more and more toward the downstream side of the wiping direction.

10. The head cleaning mechanism according to claim 9, wherein the groove is formed up to near both end portions of the inclined surface in the head widthwise direction.

11. The head cleaning mechanism according to claim 10, wherein the groove is formed so as to continue in the head widthwise direction.

12. The head cleaning mechanism according to claim 10, wherein the groove is provided in plurality with a specified distance from each other or one another in the head widthwise direction.

13. The head cleaning mechanism according to claim 9, wherein the groove is provided in plurality independently of each other or one another in the wiping direction, and the plurality of grooves are placed so as to overlap with each other or one another in the head widthwise direction.

14. The head cleaning mechanism according to claim 9, wherein the groove is provided on a wiping-direction upstream side of a position in the inclined surface with which the wiper makes contact during the wiping operation.

15. The head cleaning mechanism according to claim 9, wherein the groove has a depth within a range of 0.1 mm to 0.5 mm.

16. The head cleaning mechanism according to claim 9, wherein the recording head comprises:

an ink ejection head portion having the ink ejection surface; and a cleaning-liquid supply head portion having the inclined surface, and a lower surface extending from the downstream end of the inclined surface toward the ink ejection surface.

17. The head cleaning mechanism according to claim 1, wherein the inclined surface is processed for water repellency treatment.

18. An ink jet recording apparatus comprising the head cleaning mechanism according to claim 1.

* * * * *